US011000124B2

(12) United States Patent
Rehage et al.

(10) Patent No.: US 11,000,124 B2
(45) Date of Patent: May 11, 2021

(54) STORAGE SHELF BASE AND ITEM OF FURNITURE OR HOUSEHOLD APPLIANCE

(71) Applicant: PAUL HETTICH GMBH & CO. KG, Kirchlengern (DE)

(72) Inventors: Daniel Rehage, Chemnitz (DE); Andreas Matthes, Chemnitz (DE)

(73) Assignee: PAUL HETTICH GMBH & CO. KG, Kirchlengern (DE)

( * ) Notice: Subject to any disclaimer, the term of this patent is extended or adjusted under 35 U.S.C. 154(b) by 0 days.

(21) Appl. No.: 16/642,518

(22) PCT Filed: Aug. 27, 2018

(86) PCT No.: PCT/EP2018/072993
§ 371 (c)(1),
(2) Date: Feb. 27, 2020

(87) PCT Pub. No.: WO2019/042922
PCT Pub. Date: Mar. 7, 2019

(65) Prior Publication Data

US 2020/0187641 A1 Jun. 18, 2020

(30) Foreign Application Priority Data

Sep. 1, 2017 (DE) ..... 10 2017 120 160.2

(51) Int. Cl.
*A47B 49/00* (2006.01)
*A47B 96/02* (2006.01)
*F25D 25/02* (2006.01)

(52) U.S. Cl.
CPC ..... *A47B 49/004* (2013.01); *A47B 96/025* (2013.01); *F25D 25/027* (2013.01)

(58) Field of Classification Search
CPC ..... A47B 96/04; A47B 37/00; A47B 96/027; A47B 83/045; A47B 2037/005;
(Continued)

(56) References Cited

U.S. PATENT DOCUMENTS 535,886 A * 3/1895 Brand ..... F04D 25/08 5/173
2,316,408 A * 4/1943 Dawson ..... F16H 25/14 74/55

(Continued)

FOREIGN PATENT DOCUMENTS

DE 4216765 A1 12/1992
DE 102017106170 A1 9/2018
EP 3159635 A1 4/2017

OTHER PUBLICATIONS

International Search Report dated Sep. 24, 2018 in related/corresponding International Application No. PCT/EP2018/072993.

(Continued)

*Primary Examiner* — Hanh V Tran
(74) *Attorney, Agent, or Firm* — Patent Portfolio Builders PLLC

(57) ABSTRACT

A storage shelf base for an item of furniture or household appliance, includes a base plate stationarily secured to a body of the item of furniture or household appliance, a support plate arranged on the base plate, and a storage shelf, which is positively driven relative to the support plate and can simultaneously be moved rotationally and translationally. Facing bearing surfaces of the support plate and the storage shelf have respective at least substantially closed circulating running grooves, in which rolling elements are guided. The storage shelf is movable relative to the support plate, out of an initial position into an intermediate position, in an opening movement, in which the storage shelf is rotated relative to the support plate in a rotational direction and shifted in a predetermined direction and can be moved out of the intermediate position back into the initial position in a closing movement. The support plate has a closing-support device supporting the closing movement of the storage shelf.

14 Claims, 5 Drawing Sheets

Figure 1:
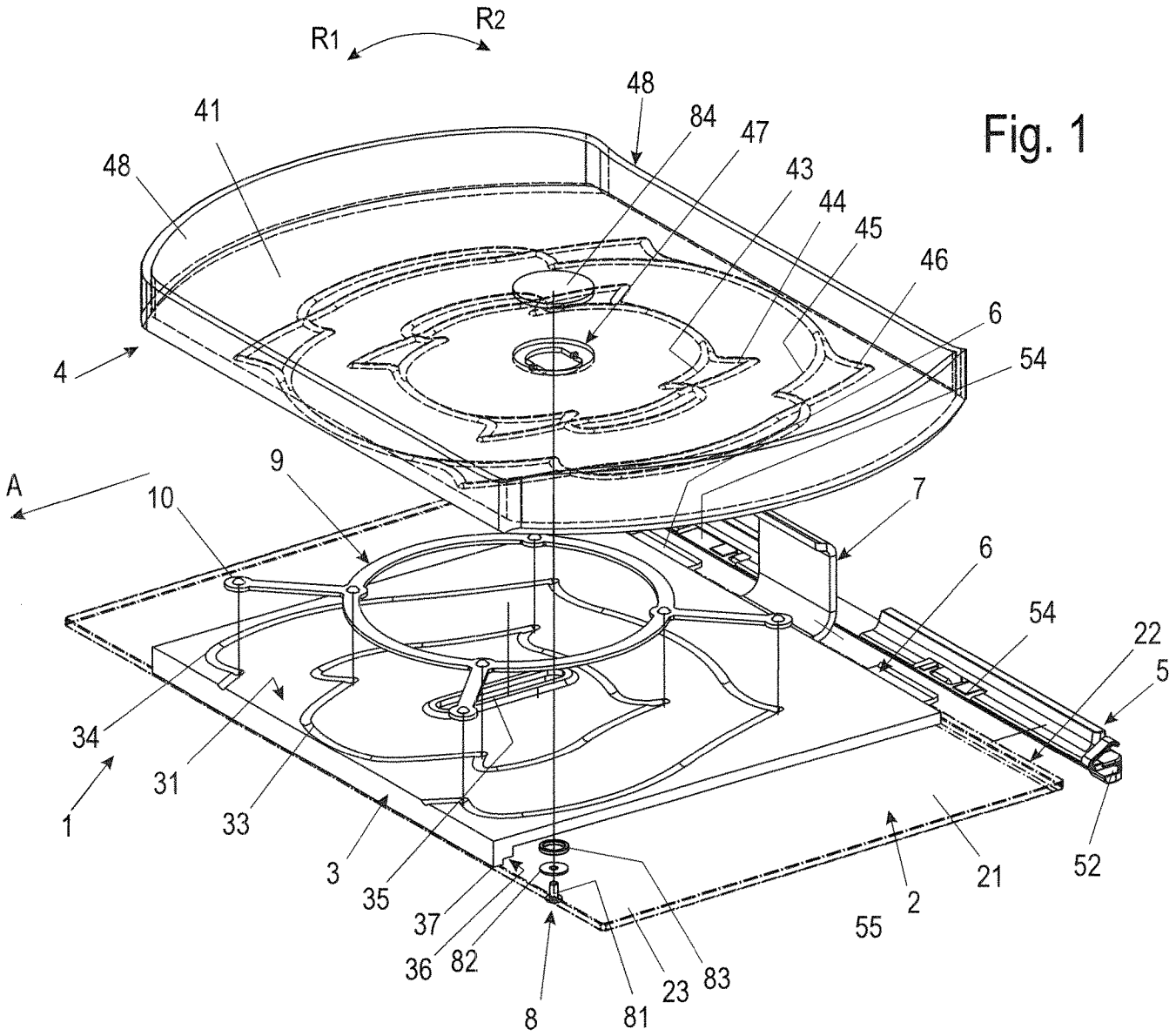

(58) Field of Classification Search
CPC ..... A47B 49/004; A47B 77/10; A47B 96/025; A47B 96/07; A47B 81/002; F25D 25/024; F25D 25/027
See application file for complete search history.

(56) References Cited

U.S. PATENT DOCUMENTS 2,540,125 A * 2/1951 Kolks ..... F16C 29/04 74/55
2,647,812 A * 8/1953 Saunders ..... F25D 25/027 312/294
2,840,438 A * 6/1958 Sharpe ..... F25D 25/027 312/322
2,936,205 A * 5/1960 Clark ..... F25D 25/027 312/302
3,107,959 A * 10/1963 Maxwell, Jr. ..... F25D 25/02 312/322
4,124,262 A * 11/1978 Schill ..... A47B 49/004 16/378
4,191,437 A * 3/1980 Funke ..... A47B 49/00 108/94
4,392,628 A * 7/1983 Hadfield ..... A47B 49/004 211/144
4,485,997 A * 12/1984 Potter ..... A47B 49/00 211/163
4,582,372 A * 4/1986 Cooper ..... A47B 46/00 108/140
5,138,743 A * 8/1992 Hoffman ..... E05F 1/1223 16/303
5,143,013 A * 9/1992 Huebner ..... B63B 29/04 114/343
6,322,679 B1 * 11/2001 De Bosscher ..... H01J 37/3408 204/192.12
6,585,119 B2 * 7/2003 Palder ..... A47F 5/02 211/163
7,147,445 B2 * 12/2006 Krayer ..... F16N 13/20 418/150
9,022,495 B1 * 5/2015 Conner, Sr. ..... F25D 25/027 312/408
9,052,134 B1 * 6/2015 Batchler ..... F25D 25/02
9,528,753 B1 * 12/2016 Conner, Sr. ..... A47F 3/08
2002/0117943 A1 * 8/2002 Gerkey ..... A47B 49/006 312/238
2005/0196310 A1 * 9/2005 Krayer ..... A47B 81/002 418/61.3
2009/0079305 A1 * 3/2009 Hirayoshi ..... A47B 46/00 312/209
2010/0129184 A1 * 5/2010 Thogersen ..... B62D 63/06 414/467
2010/0176074 A1 * 7/2010 Andersen ..... A47F 5/0087 211/59.2
2017/0184335 A1 * 6/2017 Jeon ..... F25D 23/04
2020/0018349 A1 * 1/2020 Rehage ..... A47B 96/025
2020/0170408 A1 * 6/2020 Rehage ..... A47B 96/025
2020/0187641 A1 * 6/2020 Rehage ..... A47B 49/004
2020/0191471 A1 * 6/2020 Rehage ..... F25D 25/027

OTHER PUBLICATIONS

Written Opinion dated Sep. 24, 2018 in related/corresponding International Application No. PCT/EP2018/072993.

* cited by examiner

STORAGE SHELF BASE AND ITEM OF FURNITURE OR HOUSEHOLD APPLIANCE

BACKGROUND AND SUMMARY OF THE INVENTION

Exemplary embodiments of the present invention relate to a storage shelf base for an item of furniture or household appliance and an item of furniture or household appliance.

Storage shelf bases of this type, in which a support plate and a storage shelf guided on the support plate are arranged on a base plate and can be moved simultaneously in rotation and translation, allow access to otherwise inaccessible surfaces in the storage space of an item of furniture or household appliance such as a refrigerator or freezer.

For example, DE 42 16 765 A1 discloses storage shelf bases equipped with a turntable where the turntable is installed directly in the base plate of the storage shelf base.

The post-published DE 10 2017 106 170 A1 discloses a storage shelf that is positively guided relative to the support plate and can be moved simultaneously in rotation and translation.

A disadvantage of these prior art storage shelf bases is that sometimes the initial position of the storage shelf, which it occupies, for example, in the storage space closed by a door of the furniture or household appliance, is not always reached.

If this initial position is not reached, this may lead to malfunctions in the support of the storage shelf on the support plate during a subsequent attempt to move the storage shelf from its initial position to an intermediate position intended for loading or unloading. It can also happen that the door no longer closes properly. In the worst case, trying to close the door with a lot of force can damage the storage shelf.

Exemplary embodiments of the present invention are directed to a storage shelf base for an item of furniture or household appliance so that the defined initial position is reliably reached when the shelf is inserted into this initial position.

The storage shelf base according to the invention has a support plate arranged on the body of the furniture or household appliance.

The storage shelf base also has a storage shelf that is positively guided relative to the support plate and can be moved simultaneously in rotation and translation, wherein the bearing surfaces of the support plate and the storage shelf facing each other have at least predominantly closed circumferential grooves in which rolling elements are guided.

The storage shelf is movable relative to the support plate in an opening movement from an initial position to an intermediate position, in which the storage shelf is rotated relative to the support plate in one direction and displaced in a predetermined direction, wherein the storage shelf is movable from the intermediate position back to the initial position in a closing movement. The storage shelf base has a closing-support device which supports the closing movement of the shelf.

The integration of closing support makes it easy to reach the defined initial position.

An additional advantage of the shelf is that it has a base plate that is fixed in a stationary manner to the body of the furniture or household appliance and on which the support plate is arranged, wherein the closing-support device acts between the base plate and the support plate.

In accordance with an advantageous embodiment, the closing-support device is formed by a wedge-shaped web or by a ribbed structure between the base plate and the support plate. The web or rib structure can be formed either on the base plate or on the support plate.

Alternatively, the web or rib structure can also be formed by a separate component arranged on the base plate and/or on the support plate.

According to another advantageous embodiment variant of the storage shelf base, the closing-support device supporting the closing movement of the storage shelf is designed as at least one step on the base plate or on the support plate, preferably on an underside of the support plate facing the base plate in the area of a front edge.

Such a step is easy and inexpensive to attach to or integrally form on the base plate and/or support plate.

In addition, such a step can be kept small in construction and thus has only a very small influence on the overall height of the storage shelf base.

The step is preferably integrally formed on the support plate. It is also conceivable to attach such a step to a support plate.

The step causes a common inclination of the mutually facing bearing surfaces of the support plate and the storage shelf in relation to the horizontal, so that a plane on which the axes or points of rotation of the rolling elements lie is also inclined in relation to the horizontal.

In accordance with an advantageous embodiment variant, the height of the step is dimensioned so that the inclination of the support plate in the closing direction relative to the base plate is between 1° and 5°, preferably between 1° and 2°.

Such an inclination is sufficient for a reliable retraction of the storage shelf into its initial position while at the same time having very little influence on the overall height of the storage shelf base. The low inclination also prevents the objects arranged on the storage shelf from slipping.

According to another advantageous embodiment variant of the invention, the geometry of the running grooves is such that the movement of the storage shelf immediately before reaching the initial position contains a translational component; the direction of movement of the storage shelf immediately before reaching the initial position is particularly advantageous as it is approximately linear. In particular, this enables the storage shelf to be moved into the defined initial position.

The storage shelf base according to the invention can preferably be used in an item of furniture or in a household appliance, especially in a refrigerator or freezer. In addition, the furniture or household appliance each has a body for receiving the storage shelf base.

BRIEF DESCRIPTION OF THE DRAWING FIGURES

Figure 2:
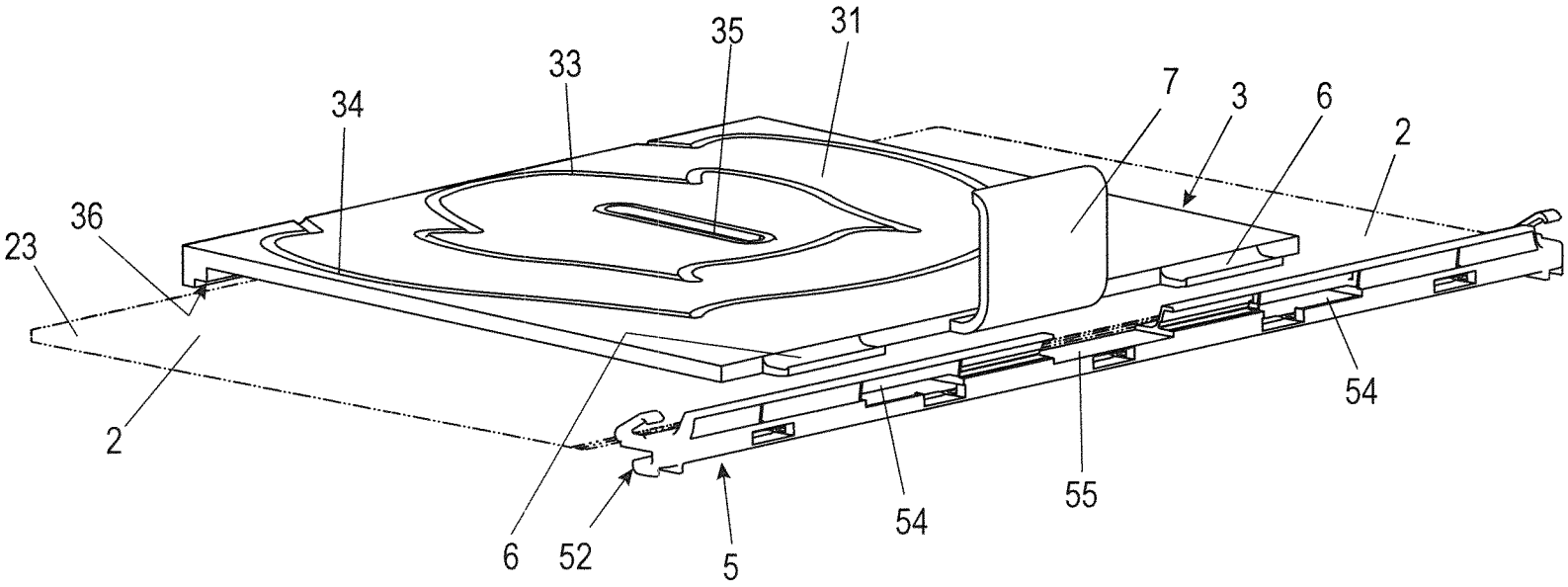
Figure 3:
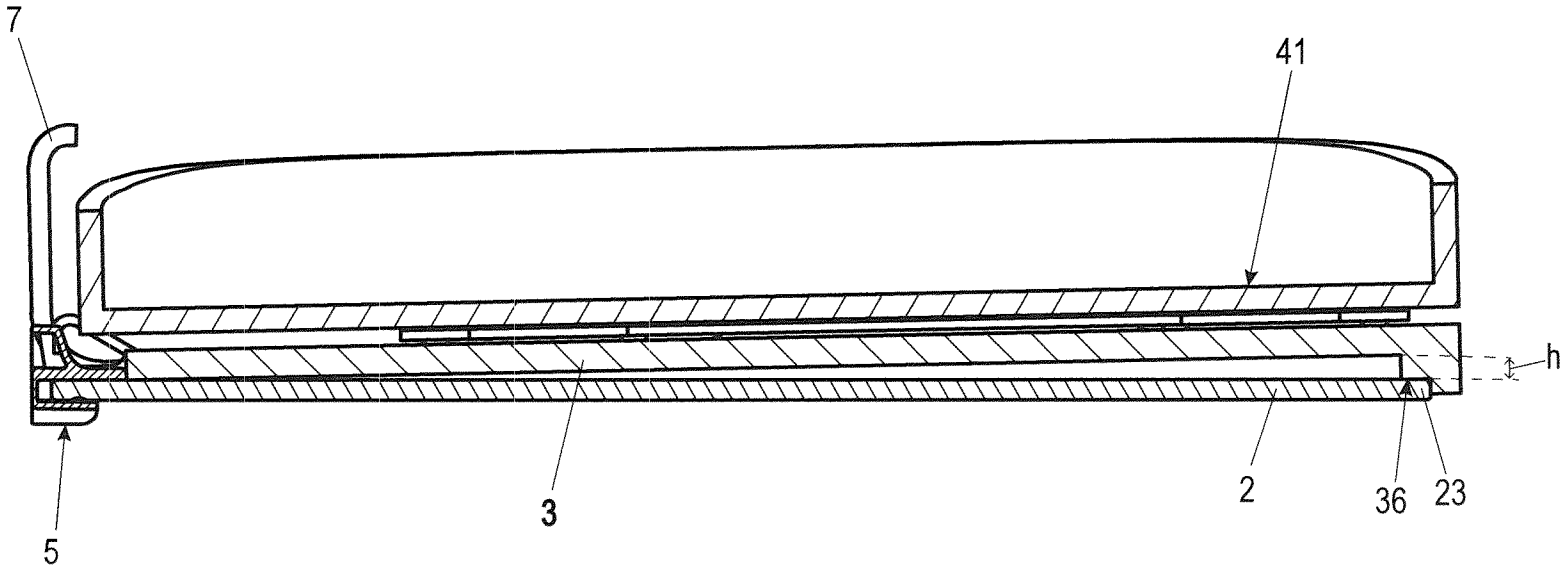
Figure 4:
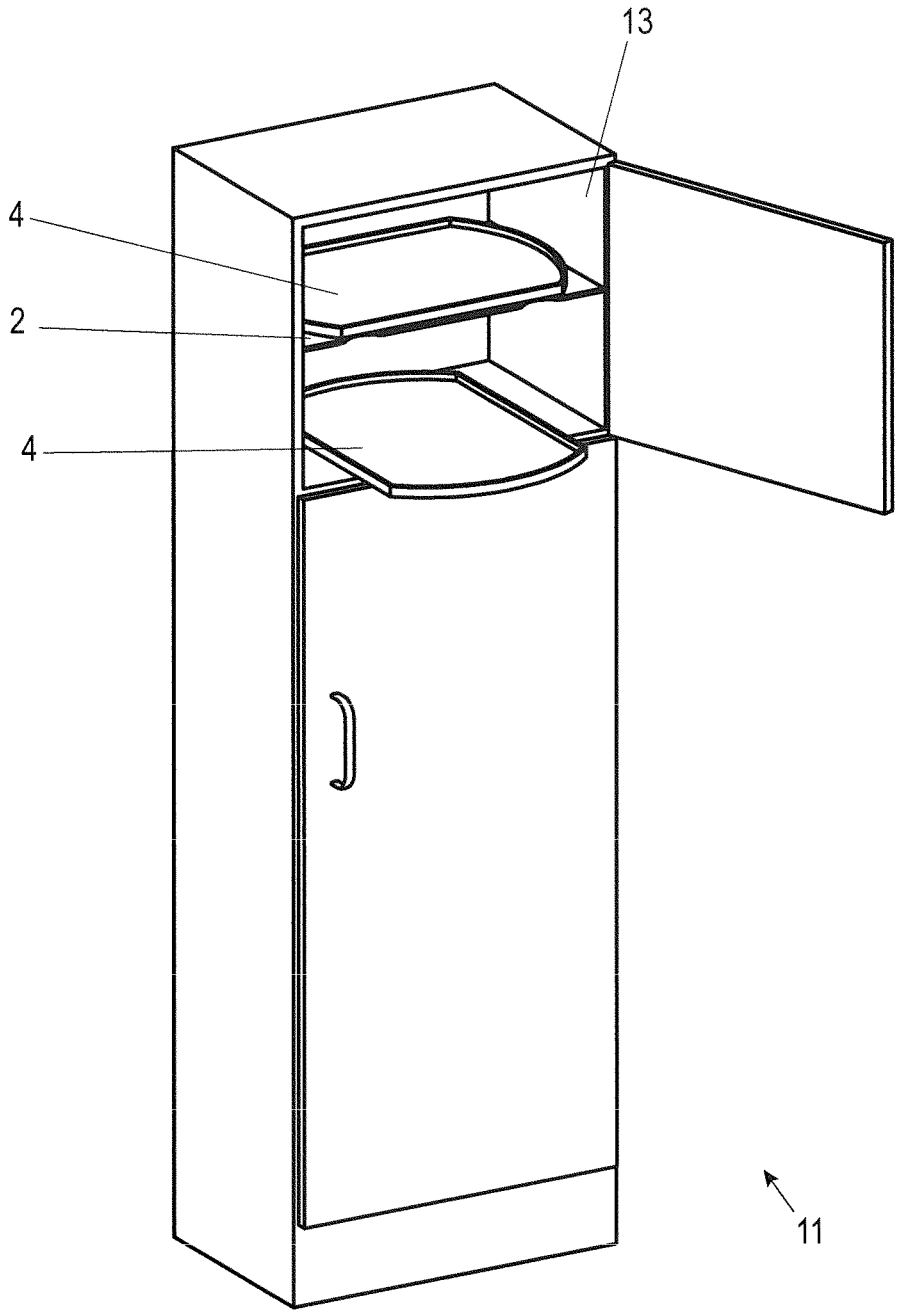
Figure 5:
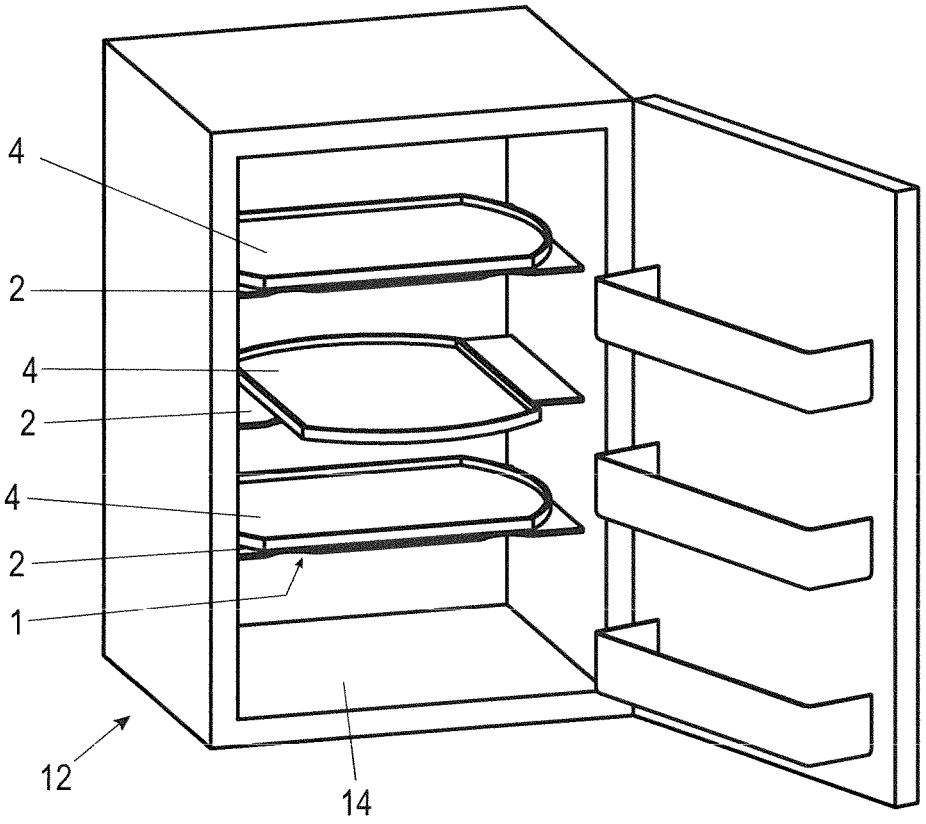

In the following, preferred embodiment examples of the invention are explained in more detail using the enclosed drawings, wherein:

FIG. 1 shows a perspective exploded view of an embodiment variant of a storage shelf base according to the invention, FIG. 2 shows a perspective view of the base plate, the support plate and the base plate holder in an exploded view, FIG. 3 shows a sectional view through the storage shelf base according to FIG. 1, FIG. 4 shows a perspective view of an item of furniture with storage shelf bases built into it, and FIG. 5 shows a perspective view of a household appliance designed as a refrigerator with storage shelf bases built into it.

DETAILED DESCRIPTION

In the following figure description, terms such as top, bottom, left, right, front, back, etc. refer exclusively to the exemplary representation and position of the storage shelf base, base plate, support plate, storage shelf, base plate holder, step and the like selected in the respective figures. These terms are not to be understood restrictively, i.e. these references can change due to different working positions or the mirror-symmetrical interpretation or the like.

In FIG. 1, the reference numeral 1 denotes a storage shelf base as a whole.

The storage shelf base 1 has a base plate 2, which can be fixed to a body 13, 14 of an item of furniture 11 or household appliance 12 and a support plate 3, which is arranged on the base plate 2.

On this support plate 3 there is a storage shelf 4, which can be moved simultaneously in rotation and in translation. For positively guided simultaneous rotational and translational movement, mutually facing bearing surfaces 31, 42 of the support plate 3 and the storage shelf 4 each have at least predominantly closed circumferential running grooves 33, 34, 43, 44, 45, 46 in which rolling elements 10 are guided. The rolling elements 10 used here are in particular balls.

The support plate 3 is detachably fastened to the base plate 2 or, as shown in FIG. 1, to a base plate holder 5 fixing the base plate 2 to the body 13, 14 of the item of furniture 11 or household appliance 12.

As shown in FIGS. 1 and 2, inner running grooves 33, 43, 44 and, for improved support of the storage shelf 4, outer running grooves 34, 45, 46 are introduced both into the bearing surface 31 of the support plate 3 facing the storage shelf 4 and into the bearing surface 42 of the storage shelf 4 facing the support plate 3.

The inner running groove 33 of support plate 3 is designed as a closed circumferential running groove. The outer running groove 34 is open towards a front side of storage shelf base 1.

For forced simultaneous rotational and translational movement of storage shelf 4, two partially overlapping inner running grooves 43, 44 and two likewise partially overlapping outer running grooves 45, 46 are each inserted into the bearing surface 42 of storage shelf 4. All running grooves 43, 44, 45, 46 are designed as closed circumferential running grooves.

To prevent the loss of this rolling element 10, the rolling elements 10 are accommodated in a rolling element cage 9. The rolling element cage 9 here is in the form of a circular ring with four arms extending radially outwards from the circular ring, at each of whose free end a further rolling element 10 is accommodated.

Both the inner running grooves 33, 43, 44 and the outer running grooves 34, 45, 46 are shaped in such a way that, when force is applied to the storage shelf 4 in the horizontal direction, the storage shelf 4 can be moved from an initial point corresponding to the orientation of the storage shelf 4 relative to the support plate 3 as shown in FIG. 1 via an intermediate position shown in FIG. 4 with respect to the lower storage shelf 4 into a loading or unloading position rotated by 90°, in which the storage shelf 4 is not only rotated by 90°, but is also displaced by a predetermined distance A to facilitate loading and unloading.

The movement back to the initial position is equally simple by exerting force in the horizontal direction in the closing direction, in which the storage shelf 4 is moved into a position turned by 180° to the initial position while maintaining the initial direction of rotation, or back into the initial position while reversing the direction of rotation.

As shown in FIGS. 1 and 2, a base plate holder 5 is used to fasten the storage shelf base 1 to body 13, 14 of the item of furniture 11 or household appliance 12. For this purpose, the base plate holder 5 engages around a rear edge 22 of the base plate 2.

In the embodiment example shown here, the support plate 3 is also connected to the base plate holder 5 via connecting elements 6 in order to fix the support plate 3 in a fixed position on the base plate 2. The base plate holder 5 represents a possible form of an adapter for the subsequent attachment of a support plate 3 to a body 13, 14.

For this purpose, the base plate holder 5 has two recesses 54 into which a respective connecting element 6 extending from a rear edge of the support plate 3 can be inserted.

The respective connecting element 6 is held in the base plate holder 5 in a form-fit or friction-locked manner when pushed into the recess 54.

In order to ensure a reliable retraction of the storage shelf 4 into the closing position, the support plate 3 is not supported horizontally evenly on the base plate 2, but inclined slightly backwards in the direction of the base plate holder 5.

For this purpose, a step 36 is formed on the underside of a front edge of the support plate 3 facing the base plate 2, as shown in FIGS. 1, 2 and 3.

In the special embodiment variant shown here, two such steps 36, 37 are integrally formed, wherein an inner step 36 rests on the upper side 21 of the base plate 2 facing the support plate 3, while a front edge 23 of the base plate 2 rests on a vertical inner surface of an outer step 37 which covers base plate 2 at the front side.

It is also conceivable to provide only one step with which the front edge of the support plate 3 rests on the base plate 2.

It is also conceivable to design the step as a separate component attached to the underside 32 of the support plate 3 or to the upper side 22 of the base plate 2.

As an alternative to the step integrally formed on a front edge of the support plate 3, the underside of the support plate 3 facing the base plate 2 can also run diagonally to the upper side of the support plate 3 over the entire surface. The underside can also be arranged in a ribbed manner.

A wedge-shaped web can also be arranged between base plate 2 and support plate 3.

The height h of step 36 is dimensioned so that the inclination of the support plate 3 in the closing direction relative to the base plate 2 is between 1° and 5°.

The inclination of the support plate 3 in the closing direction relative to the base plate 2 is particularly preferred between 1° and 2°.

The slope of the support plate 3 in the direction of the base plate holder 5 created by this step is sufficient for reliable retraction of the storage shelf 4 after actuation of a user of the shelf to move the shelf from the intermediate position to its initial position or rotated 180° to the initial position.

The geometry of the inner running grooves 33, 43, 44 and, if present, of the outer running grooves 34, 45, 46 is preferably designed in such a way that the direction of movement of the storage shelf 4 immediately before reaching the initial position contains a translatory component or is even approximately linear, so that the potential energy inherent in the storage shelf 4 is converted into kinetic momentum before reaching the defined initial position, so that the storage shelf 4 reliably reaches its initial position without further pushing of the storage shelf 4 by a user.

As shown in FIGS. 1 and 2, the base plate holder 5 has a second recess 55 above the slot 52, which serves to accommodate a tilting protection element 7.

Such a tilting protection element 7 is also arranged on the support plate 3 and shaped in such a way that it overlaps an upper edge 48 of the storage shelf 4. Alternatively, the tilting protection element can be designed in such a way that it engages in a groove in the storage shelf.

The tilting protection element 7 serves to prevent a tilting movement of the storage shelf 4 around a tilting axis parallel to the shelf surface 41 of the storage shelf 4. Such a tilting movement can occur in particular when loads are distributed unevenly on shelf surface 41 of storage shelf 4.

The tilting protection element 7 is preferably designed as a C-shaped catch hook, wherein a section 73 of the tilting protection element 7 protrudes from the rear edge of the support plate 3 and is bent upwards.

A flat central section 72 adjoins this section 73, wherein the height extension of which is adapted to the vertical height of a wall surrounding the shelf surface 41 of the storage shelf 4, wherein a bent end 71 of the tilting protection element 7 adjoining the central section 72 projects beyond its upper edge 48 and, in the event of a tilting movement, prevents the storage shelf 4 from tilting.

The support plate 3 and the storage shelf 4 are fixed to each other for axial fixing by means of a fixing device 8.

As shown in FIG. 1, the fixing device 8 has a screw 81, which protrudes from below through a slot 35 in the support plate 3, thus enabling a displacement movement of the storage shelf 4 relative to the support plate 3.

In order to enable a low-friction displacement movement, a washer 82 and a sliding ring 83 are placed on screw 81, which sliding ring 83 is in contact with the underside of the support plate 3 facing the base plate 2 in the area of slot 35. The inclination of the support plate 3 to the base plate 2 also ensures that the head of the screw 81, which protrudes downwards over the support plate 3, does not grind on the base plate 2. This ensures optimum movement of the storage shelf 4.

For axial fixation with the storage shelf 4, a mounting bracket 47 is inserted in the shelf surface 41 of the storage shelf 4, which is covered by a cap 84.

The underside of this cap 84 facing screw 81 is provided with a screw hole with an internal thread into which screw 81 can be screwed, thus holding the cap 84 axially in its mounting position.

The base plate 2 can be designed as a glass plate. It is also conceivable to design a base plate 2 as a wooden plate or a plate made of plastic or metal. The support plate 3 and the storage shelf 4 are preferably made of plastic or glass.

It is particularly advantageous that, for example, in the case of a household appliance 12 designed as a refrigerating appliance, such as in particular a refrigerator or freezer, an already existing base plate 2, for example in the form of a glass plate, can be used to stabilize and retrofit the support plate and the shelf to create a storage shelf base 1, which can be moved simultaneously by translation and rotation and is therefore particularly easy to load or unload.

FIG. 4 shows the storage shelf bases according to the invention in an item of furniture 11, wherein the item of furniture 11 has a body 13 in which the storage shelf bases 1 are arranged.

FIG. 5 shows storage shelf bases according to the invention in a household appliance, in this case a refrigerating appliance, 12, wherein the household appliance 12 has a body 14 in which the storage shelf bases 1 are arranged.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 Storage shelf base
2 Base plate
21 Upper side
22 Edge
23 Edge
3 Support plate
31 Bearing surface
32 Underside
33 Running groove
34 Running groove
35 Slot
36 Step
37 Step
4 Storage shelf
41 Shelf surface
42 Bearing surface
43 Running groove
44 Running groove
45 Running groove
46 Running groove
47 Mounting bracket
48 Upper edge
5 Base plate holder
52 Slot
54 First recess
55 Second recess
6 Connecting element
7 Tilting protection element
8 Fixing device
81 Screw
82 Washer
83 Sliding ring
84 Cap
9 Rolling element cage
10 Rolling elements
11 Item of furniture
12 Household appliance
13 Body
14 Body
A Direction
$R_1$ Direction of rotation $R_2$ Direction of rotation
h Height

The invention claimed is:

1. A storage shelf base for an item of furniture or household appliance, the storage shelf base comprising:

a support plate arranged on a body of the item of furniture or household appliance;

a storage shelf, which is positively guided relative to the support plate and simultaneously movable in rotation and translation, wherein mutually facing bearing surfaces of the support plate and of the storage shelf have respective at least predominantly closed, circumferential running grooves in which rolling elements are guided, wherein the storage shelf is movable relative to the support plate in an opening movement from an initial position into an intermediate position, in which the storage shelf is rotated relative to the support plate in a direction of rotation and displaced in a predetermined direction and is movable in a closing movement from the intermediate position back into the initial position or further into the one direction of rotation into a position rotated through 180° to the initial position, and wherein the storage shelf base has a closing-support device supporting the closing movement of the storage shelf.

2. The storage shelf base of claim 1, wherein the storage shelf base has a base plate fastened in a stationary manner to the body of the item of furniture or household appliance, the support plate is arranged on the base plate, and the closing-support device is configured to act between the base plate and the support plate.

3. The storage shelf base of claim 2, wherein the closing-support device is a wedge-shaped web between the base plate and the support plate, or a ribbed structure.

4. The storage shelf base of claim 2, wherein the closing-support device supporting the closing movement of the storage shelf is at least one step on the base plate or on the support plate.

5. The storage shelf base of claim 4, wherein the closing-support device supporting the closing movement of the storage shelf is the at least one step on the support plate, and the at least one step is on an underside of the support plate facing the base plate in the region of a front edge of the support plate.

6. The storage shelf base of claim 3, wherein a plane, on which the axes or points of rotation of the rolling elements lie, is inclined with respect to horizontal by the wedge-shaped web or by the ribbed structure.

7. The storage shelf base of claim 4, wherein a plane, on which the axes or points of rotation of the rolling elements lie, is inclined with respect to horizontal by the at least one step.

8. The storage shelf base of claim 4, wherein the at least one step is integrally formed on the base plate or on the support plate.

9. The storage shelf base of claim 4, wherein a height of the at least one step is dimensioned such that an inclination of the support plate in a closing direction relative to the base plate is between 1° and 5°.

10. The storage shelf base of claim 9, wherein the height of the at least one step is dimensioned such that an inclination of the support plate in the closing direction relative to the base plate is between 1° and 2°.

11. The storage shelf base of claim 1, wherein a geometry of the circumferential running grooves is configured in such a way that the movement of the storage shelf immediately before reaching the initial position contains a translatory movement component.

12. The storage shelf base of claim 1, wherein a geometry of the circumferential running grooves is configured in such a way that the direction of movement of the storage shelf is approximately rectilinear immediately before reaching the initial position.

13. An item of furniture, comprising:

a body;

a storage shelf arranged in the body; and at least one storage shelf base, comprising a support plate arranged on the body of the item of furniture, wherein the storage shelf is positively guided relative to the support plate and simultaneously movable in rotation and translation, wherein mutually facing bearing surfaces of the support plate and of the storage shelf have respective at least predominantly closed, circumferential running grooves in which rolling elements are guided, wherein the storage shelf is movable relative to the support plate in an opening movement from an initial position into an intermediate position, in which the storage shelf is rotated relative to the support plate in a direction of rotation and displaced in a predetermined direction and is movable in a closing movement from the intermediate position back into the initial position or further into the one direction of rotation into a position rotated through 180° to the initial position, and wherein the storage shelf base has a closing-support device supporting the closing movement of the storage shelf.

14. A refrigerator or freezer, comprising:

a body;

a storage shelf arranged in the body; and at least one storage shelf base, comprising a support plate arranged on the body of the refrigerator or freezer, wherein the storage shelf is positively guided relative to the support plate and simultaneously movable in rotation and translation, wherein mutually facing bearing surfaces of the support plate and of the storage shelf have respective at least predominantly closed, circumferential running grooves in which rolling elements are guided, wherein the storage shelf is movable relative to the support plate in an opening movement from an initial position into an intermediate position, in which the storage shelf is rotated relative to the support plate in a direction of rotation and displaced in a predetermined direction and is movable in a closing movement from the intermediate position back into the initial position or further into the one direction of rotation into a position rotated through 180° to the initial position, and wherein the storage shelf base has a closing-support device supporting the closing movement of the storage shelf.

* * * * *